US011592272B2

(12) United States Patent
Bugge et al.

(10) Patent No.: US 11,592,272 B2
(45) Date of Patent: Feb. 28, 2023

(54) AERO-ASSISTED MISSILE FIN OR WING DEPLOYMENT SYSTEM

(71) Applicant: Raytheon Company, Waltham, MA (US)

(72) Inventors: John F. Bugge, Tucson, AZ (US); Byron T. Edgar, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 101 days.

(21) Appl. No.: 17/158,869

(22) Filed: Jan. 26, 2021

(65) Prior Publication Data

US 2022/0236041 A1 Jul. 28, 2022

(51) Int. Cl.
*F42B 10/14* (2006.01)

(52) U.S. Cl.
CPC ..... *F42B 10/14* (2013.01)

(58) Field of Classification Search
CPC ... F42B 10/14; B64C 5/02; B64C 5/08; B64C 5/10; B64C 5/12; B64C 2201/102
See application file for complete search history.

(56) References Cited

U.S. PATENT DOCUMENTS 3,978,790 A * 9/1976 Sandelius ..... F42B 10/14 102/388
5,668,347 A * 9/1997 Mikhail ..... F42B 10/14 244/3.28
5,744,748 A 4/1998 Mikhail
6,126,109 A * 10/2000 Barson ..... F42B 10/14 244/3.28
6,314,886 B1 * 11/2001 Kuhnle ..... F42B 10/14 244/3.28
8,324,545 B2 * 12/2012 Ashkenazi ..... F42B 10/16 244/3.28
2009/0008496 A1 * 1/2009 Feuerstein ..... F42B 10/14 244/3.28

FOREIGN PATENT DOCUMENTS

EP 024888 A1 3/1987
EP 1947415 A1 7/2008

OTHER PUBLICATIONS

International Search Report and Written Opinion dated Dec. 3, 2021 in corresponding International Application No. PCT/US2021/027598.

* cited by examiner

*Primary Examiner* — Benjamin P Lee
(74) *Attorney, Agent, or Firm* — Renner, Otto, Boisselle & Sklar, LLP

(57) ABSTRACT

A projectile and method of deploying a projectile includes a wing deployment system for deploying a wing of a projectile. The wing deployment system includes a stored energy release mechanism that is activated to generate an initial range of motion of the wing and a panel arranged on the wing and configured to cause an angular acceleration of the wing during the initial range of motion of the wing.

17 Claims, 6 Drawing Sheets

AERO-ASSISTED MISSILE FIN OR WING DEPLOYMENT SYSTEM

GOVERNMENT LICENSE RIGHTS

This invention was made with Government support under contract number DOTC-17-01-INIT0987, awarded by the Department of Defense. The Government has certain rights in the invention.

FIELD OF THE DISCLOSURE

The disclosure relates to munitions, and more particularly, to a missile fin or wing deployment system.

DESCRIPTION OF THE RELATED ART

Projectiles that are launched by guns or tubes may be suitable for different applications. For example, military applications that use munitions may be a suitable application. The projectiles include fins or wings to increase the stability of the projectile during and after deployment of the projectile from the gun or tube. Prior attempts to deploy the fins or wings include using explosive gas generators, springs or other stored energy mechanisms. However, the prior attempts are deficient in that they may require additional costs, manufacturing complications, undesirable added mass or bulk, and flight control disturbances in the projectile assembly.

SUMMARY OF THE DISCLOSURE

The present application provides a projectile and method of deploying a projectile that includes a wing deployment system for deploying a wing of the projectile. The wing deployment system includes an initial deployment mechanism and a panel that is arranged on the wing. The panel is configured to cause an angular acceleration of the wing during a significant range of motion of the wing. The initial deployment mechanism acts on the wing to generate the initial range of motion during which the wing moves from a folded position to a deployed position. The initial deployment mechanism may be a spring or other stored energy release mechanism that is activated by pressurization or active control in the projectile during deployment.

The panel may be a winglet or wing cover that is arranged on an upper end of the wing and configured to incur a lift or drag force when the panel is exposed to fluid flow, such as airflow, around the projectile during forward movement of the projectile. The force on the panel imparts a moment of the wing around a rotation axis of the wing to cause the angular acceleration of the wing. After the wing has reached the deployed position, the panel may be stowed within the projectile or discarded.

The wing may be configured to rotate in a forward or rearward direction relative to the forward direction of travel of the projectile. In an exemplary embodiment, the wing may be configured to rotate in a rearward direction and the panel may be formed as a winglet that is fixed to the wing during movement of the wing. In another exemplary embodiment, the wing may be configured to rotate in a forward direction and the panel may include a linkage that is connected to the panel and the wing and configured to lift the panel during the initial range of motion of the wing. The linkage may be configured to move the panel in the rearward direction, i.e. in an opposite direction relative to the rotation direction of the wing.

Using the panel as a secondary aerodynamic control surface is advantageous in that only a limited opening force is used to expose the panel to the fluid flow and consequently generate the angular acceleration of the wing. The angular acceleration of the wing ensures that the wing reaches a fully deployed position. Accordingly, in contrast to conventional wing deployment systems, the wing may be deployed without complex and bulky devices. Still another advantage of the panel is that high angular acceleration is caused rapidly during the initial range of motion of the wing. This enables the wing including the wing deployment system to deploy in a short timescale, such as between 10 and 50 milliseconds, which may be desirable for particular applications.

According to an aspect of the disclosure, a wing deployment system may include a secondary aerodynamic control surface for a wing of a projectile.

According to an aspect of the disclosure, a wing deployment system may include a panel that is arranged on a wing of a projectile and configured to generate angular acceleration of the wing.

According to an aspect of the disclosure, a wing deployment system may include a winglet removably attached to a wing of a projectile.

According to an aspect of the disclosure, a wing deployment system may include a panel and a linkage.

According to an aspect of the disclosure, a projectile may include a wing and a secondary aerodynamic control surface arranged on the wing.

According to an aspect of the disclosure, a method of deploying a projectile may include using a panel to cause angular acceleration of a wing during an initial range of motion of the wing.

According to an aspect of the disclosure, a method of deploying a projectile may include stowing or discarding a secondary aerodynamic control surface for a wing of a projectile after the wing has reached a deployed position.

According to an aspect of the disclosure, a wing deployment system for deploying a wing of a projectile includes an initial deployment mechanism that acts on the wing to generate an initial range of motion of the wing during which the wing moves from a folded position to a deployed position, a panel arranged on the wing and configured to cause an angular acceleration of the wing during the initial range of motion of the wing.

According to an embodiment of any paragraph(s) of this summary, the panel may be configured to incur a lift or drag force when the panel is exposed to fluid flow around the projectile, the lift or drag force on the panel imparting a moment of the wing around a rotation axis of the wing to cause the angular acceleration.

According to an embodiment of any paragraph(s) of this summary, the panel may have at least one surface that extends perpendicular to a side of the wing.

According to an embodiment of any paragraph(s) of this summary, the panel may be arranged at an end of the wing that is opposite a rotation axis of the wing.

According to an embodiment of any paragraph(s) of this summary, the panel may have opposing flaps that extend outwardly from opposing sides of the wing.

According to an embodiment of any paragraph(s) of this summary, the panel may be a winglet having a U-shaped body that is inserted into a slot formed in the wing.

According to an embodiment of any paragraph(s) of this summary, the wing deployment system may include a linkage connected between the panel and the wing for lifting the panel during the initial range of motion of the wing.

According to an embodiment of any paragraph(s) of this summary, the linkage may have a first end pivotably connected to the panel and a second end that is opposite the first end and pivotably connected to the wing.

According to an embodiment of any paragraph(s) of this summary, the linkage may be configured to pivot the panel in an opposite rotational direction relative to a rotational direction in which the wing is pivoted during movement from the folded position to the deployed position.

According to an embodiment of any paragraph(s) of this summary, the wing deployment system may include link pins arranged at the first end and the second end of the linkage.

According to an embodiment of any paragraph(s) of this summary, the panel may be removably attached to the wing and configured to be discarded from the wing after the wing is in the deployed position.

According to another aspect of the disclosure, a projectile includes a wing that is movable from a folded position to a deployed position, an initial deployment mechanism that acts on the wing to generate an initial range of motion of the wing during which the wing moves out of the folded position toward the deployed position, and a panel arranged on the wing and configured to cause an acceleration torque of the wing during the initial range of motion of the wing.

According to an embodiment of any paragraph(s) of this summary, the panel may be configured to incur a lift or drag force when the panel is exposed to fluid flow around the projectile, the lift or drag force on the panel imparting a moment of the wing around a rotation axis of the wing to cause the angular acceleration.

According to an embodiment of any paragraph(s) of this summary, the panel may be a winglet and the wing may be configured to move in a rearward direction relative to a forward direction of travel of the projectile during movement from the folded position to the deployed position.

According to an embodiment of any paragraph(s) of this summary, the wing may define a slot extending from an outer edge of the wing and the winglet is inserted in the slot.

According to an embodiment of any paragraph(s) of this summary, the winglet may have opposing flaps that extend outwardly from a U-shaped body that is received in the slot and extends along a surface of the wing.

According to an embodiment of any paragraph(s) of this summary, the panel may include a linkage connected between the panel and the wing for lifting the panel during the initial range of motion of the wing.

According to an embodiment of any paragraph(s) of this summary, the wing may be configured to move in a forward direction relative to a forward direction of travel of the projectile during movement from the folded position to the deployed position, and wherein the panel is configured to move in a rearward direction.

According to an embodiment of any paragraph(s) of this summary, wherein the panel may be configured to be discarded from the projectile after the wing is in the deployed position.

According to still another aspect of the disclosure, a method of deploying a projectile includes activating an initial deployment mechanism that acts on a wing of the projectile to generate an initial range of motion for the wing during which the wing moves out of a folded position toward a deployed position, using a panel arranged on the wing to cause an angular acceleration of the wing via a lift or drag force occurring on the panel when the panel is exposed to fluid flow around the projectile that imparts a moment of the wing around a rotation axis of the wing, and stowing or discarding the panel after the wing is in the deployed position.

To the accomplishment of the foregoing and related ends, the disclosure comprises the features hereinafter fully described and particularly pointed out in the claims. The following description and the annexed drawings set forth in detail certain illustrative embodiments of the disclosure. These embodiments are indicative, however, of but a few of the various ways in which the principles of the disclosure may be employed. Other objects, advantages and novel features of the disclosure will become apparent from the following detailed description when considered in conjunction with the drawings.

BRIEF DESCRIPTION OF DRAWINGS

The annexed drawings, which are not necessarily to scale, show various aspects of the disclosure.

DETAILED DESCRIPTION

The principles described herein have particular application in munitions and munition deployment systems, such as in tube-launched or gun-launched projectiles. The projectile and method of deploying the projectile described herein may be suitable for use in military applications. Non-lethal applications and non-military applications may also be suitable, such as surveillance systems. The projectile is suitable for deployment in any environment and may be carried on any suitable platform. Exemplary environments include air, space, and sea, and exemplary platforms include aircraft, hypersonic or supersonic vehicles, land vehicles, or watercraft.

Figure 1:
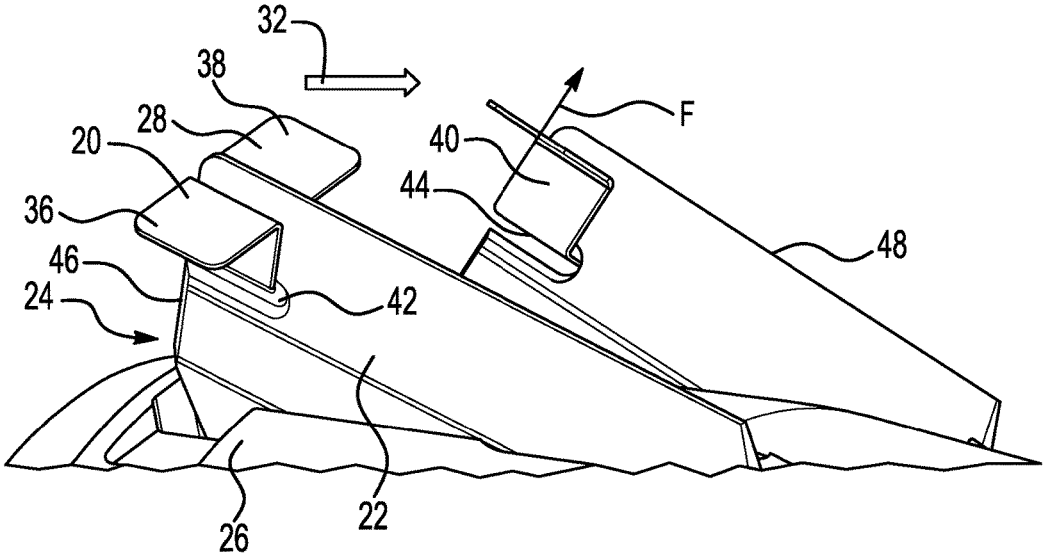
FIG. 1 shows a wing deployment system for a projectile according to an exemplary embodiment of the present application in which the wing deployment system includes a winglet inserted into a deployable wing.
Figure 2:
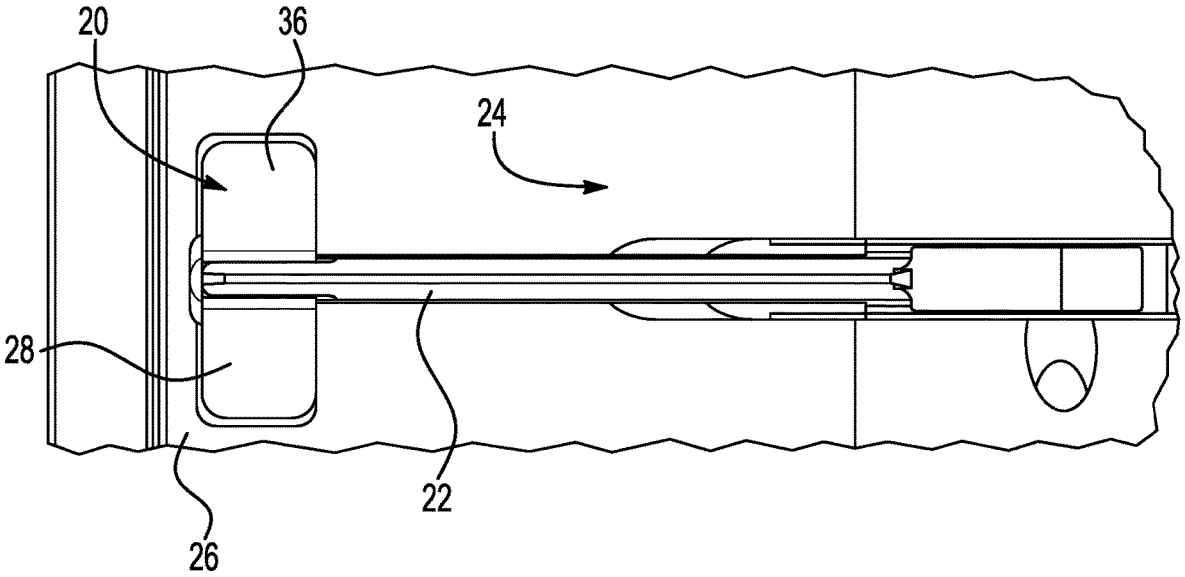
FIG. 2 shows a top view of the wing deployment system of FIG. 1.
Figure 3:
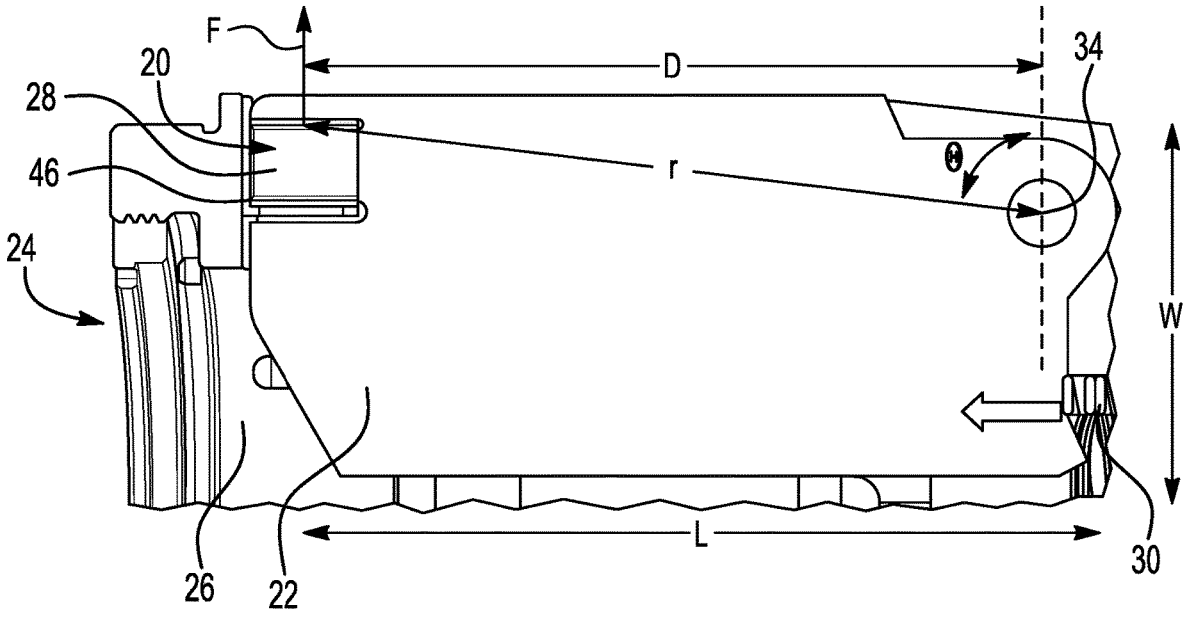
FIG. 3 shows a side view of the wing deployment system of FIG. 1.

Referring first to FIGS. 1-3, an exemplary embodiment of a wing deployment system 20 for deploying a fin or wing 22 of a projectile 24 is shown. The projectile 24 described herein may be launched or deployed from a gun or tube. The projectile 24 may be fired by initiating a primer which causes a propellant in the gun to burn thereby generating gas. The propellant may be included in the projectile 24 itself. The pressurization forces the projectile 24 out of a chamber or cartridge case of the gun. The projectile 24 may be launched from the gun using any suitable propellant and components.

A plurality of deployable wings 22 are rotatably connected to a body 26 of the projectile 24 that may disengage from a cartridge case of the gun as the projectile 24 exits the cartridge case. The body 26 may be an airframe or a fuselage of the projectile 24. When the projectile 24 is in a stowed state, the wings 22 are in a folded position, as shown in FIG. 3. The wings 22 may remain in the folded position until the entire projectile 24 has exited the muzzle of the gun. When the projectile 24 is launched from the gun or tube to move from the stowed state to a flight state, the wings 22 are rotatable relative to the body 26 to move from the folded position to a deployed position in which the wings 22 extend radially outwardly from the body 26. The wings 22 remain in the deployed position during the flight state of the projectile 24.

The wings 22 each may be formed to have any suitable shape. All of the wings 22 may be the same in shape and size. Any number of wings 22 may be provided and the number of wings 22 may be dependent on the application. For example, between four and eight wings may be suitable. More than eight wings may also be suitable for particular applications. The wings 22 may have an elongated body that extends in a forward direction from the body 26 when in the folded position. The forward direction may be defined as the direction in which the projectile 24 travels. A length L of the wings 22 in the forward direction is longer than a width W of the wings 22. The thickness of the wings 22 is less than the length L and the width W. Any suitable material may be used to form the fins. For example, a metal material such as steel may be suitable.

The wing deployment system 20 includes a panel which may be formed as a winglet 28. The winglet 28 is attached to the wing 22 and each wing 22 of the projectile 24 may have a corresponding winglet 28. The wing deployment system 20 further includes an initial deployment mechanism 30 (shown in FIG. 3) that is activated to act on the wing 22 to generate an initial range of motion of the wing 22 after the projectile 24 has exited the gun or tube. A passive or active mechanism may be used for the initial deployment mechanism 30. In an exemplary embodiment, the initial deployment mechanism 30 may include a stored energy mechanism that is activated passively by pressure generated during deployment or by control. Any suitable initial deployment mechanism may be used, such as springs that are arranged in the projectile 24 and engage the wings 22 during deployment.

The winglet 28 is configured to provide a secondary aerodynamic surface that causes angular acceleration of the entire wing 22. The winglet 28 may be formed of any suitable material. For example, the winglet 28 may be formed of a lightweight metal material, such as a lightweight steel. Other materials may be suitable. During the initial range of motion or opening motion of the wing 22, the winglet 28 is exposed to fluid flow 32, such as the air surrounding the projectile 24 during forward movement of the projectile 24 through the air. In exemplary embodiments, the initial range of motion may be between 10 and 20 degrees of rotation of the wing 22 relative to the initial folded position of the wing 22. The initial range of motion may be less than 10 degrees or greater than 20 degrees in other embodiments and the initial range of motion may be dependent on the application.

The exposure to the fluid flow 32 causes an initial lift or drag force F that occurs on the winglet 28. The drag force F occurs in a direction that is orthogonal to a line of rotation of the wing 22. As shown in FIG. 3, a moment is imparted on the wing 22 by multiplying the drag force F by the distance D between the drag force F and the rotation axis 34 of the wing 22. The moment of the force or torque T of the wing 22 may be determined using equation (1):

$$T = rF \sin \theta \qquad \text{Equation (1):}$$

In equation (1), the torque T is equal to the lever arm r sin θ multiplied by the drag force F. The lever arm is the perpendicular distance from the rotation axis 34 to the line of action of the drag force F such that r is the radius from the rotation axis 34 to the point of application of the drag force F and θ is the angle between the radius r and rotation axis 34. The moment and torque of the wing 22 overcomes inertia to provide angular acceleration of the wing 22 toward the deployed position. Per equation (1), as the wing 22 is pivoted closer to the deployed position, the angle θ will decrease such that the drag force F will provide an increasing fraction of the torque T for the wing 22.

Using the panel or winglet 28 is advantageous in ensuring full deployment of the wings 22. Due to stability, the wings 22 may deploy in a short timescale that is between 10 and 50 milliseconds such that using the initial range of motion of the wing 22 to expose the winglet 28 to the fluid flow enables deployment in applications that may require a short deployment timescale. Given that only a small opening movement is used to expose the winglet 28 to the fluid flow and cause drag of the winglet 28, conventional stored energy devices used for deployment of the wings 22 may be minimized or eliminated. In contrast to the conventional devices, using the winglet 28 provides a less complex and bulky device to generate angular acceleration of the wings 22.

In an exemplary embodiment, the winglet 28 is arranged at an end of the wing 22 that is opposite the pivot axis or rotation axis 34 of the wing 22. The wing 22 may rotate in a rearward direction relative to a forward direction of travel of the projectile 24 during movement from the folded position to the deployed position. The winglet 28 has at least one surface 36 that extends perpendicular to a side of the wing 22, meaning that the surface 36 extends outwardly from a length of the wing 22. Two opposing flaps or surfaces 36, 38 may be provided such that the surfaces 36, 38 extend opposite relative to each other and outwardly from opposing sides of the wing 22. The surfaces 36, 38 may be formed as planar surfaces that are separate from each other. For example, each of the surfaces 36, 38 may be formed as a rectangular plate having a body that is elongated relative to the thickness of the surfaces 36, 38. In exemplary embodiments, the thickness of the surfaces 36, 38 may be similar to the thickness of the wing 22.

The winglet 28 may include support surfaces 40 that are arranged perpendicular to the surfaces 36, 38 and extends along the wing 22. The support surfaces 40 may form a U-shaped body that is inserted into a slot 42 formed in the wing 22, such that the support surfaces 40 form legs of the U-shape that are connected by a curved portion 44. The winglet 28 may be formed as a monolithic and continuous component. The slot 42 may extend from an outer edge 46 of the wing 22 that is opposite the rotation axis 34 of the wing 22. A width of the slot 42 may be greater than the corresponding thickness of the curved portion 44 that is received in the slot 42 such that the winglet 28 may be easily inserted into the slot 42. The slot 42 may extend along the length L of the wing 22 and extends to a point along the length L of the wing 22 that is less than half of an entire length of the wing 22. The slot 42 may be formed along an upper half of the body of the wing 22.

The curved portion 44 of the winglet 28 engages a portion of the slot 42 such that the support surfaces 40 extend along the side surface of the wing 22 toward an upper edge 48 of the wing 22. In exemplary embodiments, the support surfaces 40 may terminate at a point along the height of the wing 22 that is less than the full height of the wing 22 such that the opposing surfaces 36, 38 extend from a point along the wing 22 that is below the upper edge 48. Other dimensions, shapes, and configurations of the winglet 28 may be suitable. In other exemplary embodiments, the winglet 28 may be formed such that the drag force incurred by the winglet 28 pulls the wing 22 toward the deployed position.

Figure 4:
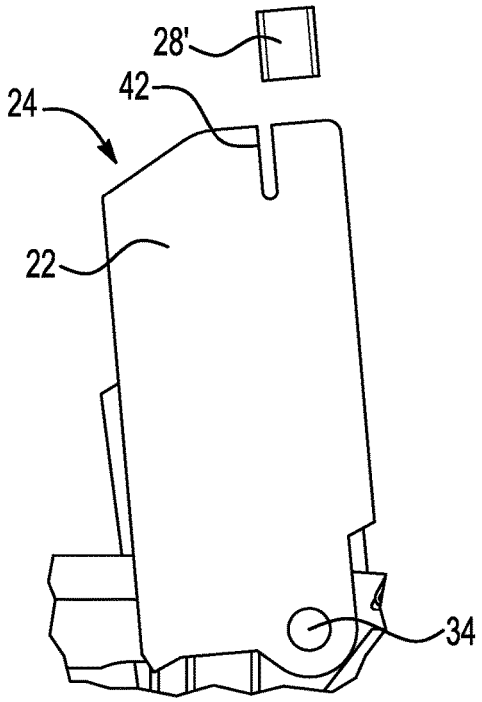
FIG. 4 shows a side view of the winglet of the wing deployment system of FIG. 1 according to an exemplary embodiment in which the winglet is discarded from the projectile after the wing is in the deployed position.
Figure 5:
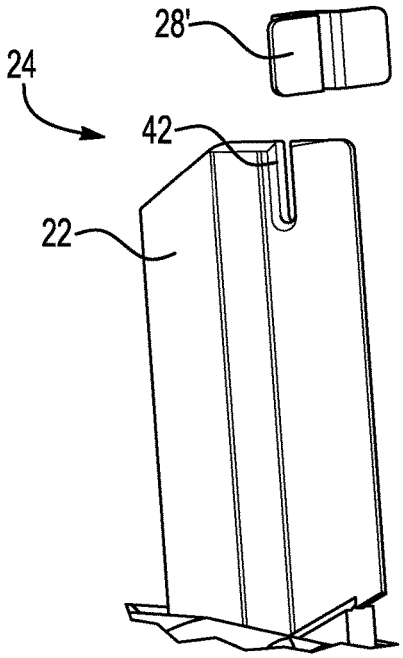
FIG. 5 shows an oblique view of the winglet of FIG. 4.

FIGS. 4 and 5 show the deployed position of the wing 22 and an exemplary embodiment of the winglet 28' in which the winglet 28' is discarded from the wing 22 after the wing 22 has reached the deployed position. The deployed position of the wing 22 may be defined by a predetermined amount of rotation of the wing 22 about the rotation axis 34. For example, a full amount of rotation of the wing 22 may be between 80 and 100 degrees from the folded position. The winglet 28' may be removably arranged in the slot 42 such that the winglet 28' may slide out of the slot 42 via the centripetal acceleration of the wing 22 after the wing 22 has rotated past the initial range of motion. Discarding the winglet 28' is advantageous in that the drag force on the winglet 28' may be detrimental to sustained flight of the projectile 24. In other exemplary embodiments, the winglet may be fixedly secured to the wing 22 or configured to be stowed or attach to the projectile 24 for the duration of the flight.

Figure 6:
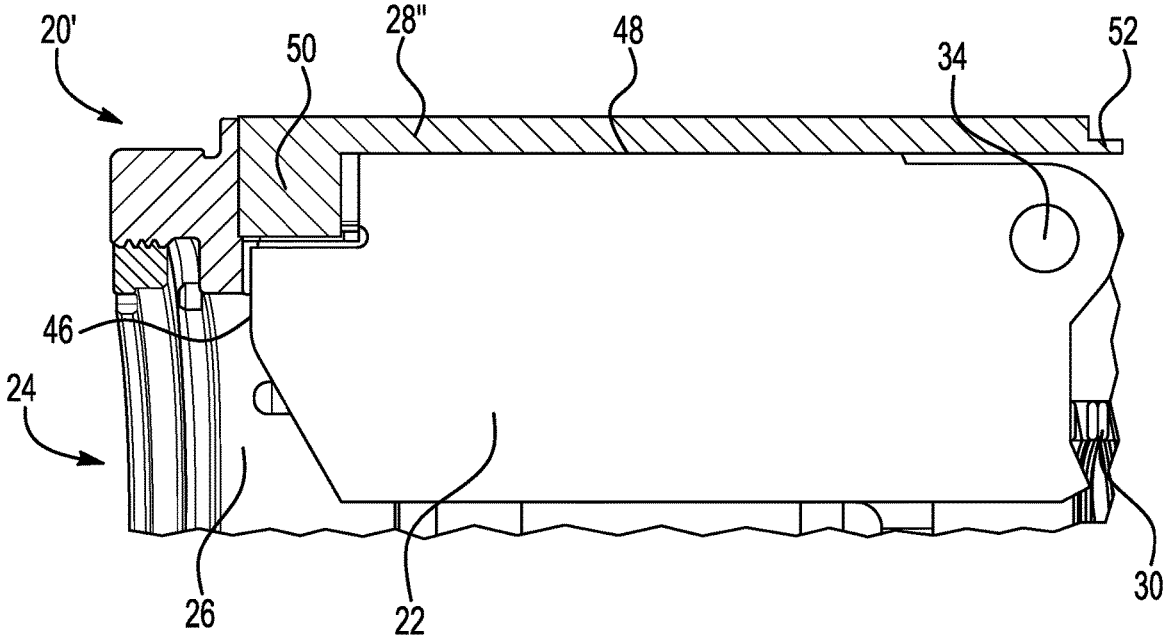
FIG. 6 shows a wing deployment system according to another exemplary embodiment in which the wing deployment system includes a panel that covers the wing.

FIG. 6 shows another exemplary embodiment of the wing deployment system 20' in which the wing deployment system 20' includes a panel 28" that is formed as a cap or cover configured to cover the wing 22. The panel 28" may extend along the upper edge 48 of the wing 22 from the outer edge 46 to the rotation axis 34, such that the panel 28" may be formed to cover an entire length of the wing 22. During the initial range of motion of the wing 22 via the initial deployment mechanism 30, the panel 28" is exposed in the fluid flow and a drag force occurs on the panel 28", similar to the winglet 28 shown in FIGS. 1-3. The drag force of the panel 28" imparts the moment to the wing 22 to provide angular acceleration of the wing 22.

The panel 28" includes a deployment catch 50 arranged proximate the outer edge 46 and a hook 52 arranged proximate the rotation axis 34. The deployment catch 50 may be used as the aerodynamic control surface for the wing 22 that extends outwardly from the wing 22 to incur the drag force. The hook 52 may be used to retain the panel 28" relative to the body 26 after the wings 22 reach the deployed position, as opposed to being discarded. For example, the wing deployment system 20' may be configured to fold flush relative to the body 26 of the projectile 24. The hook 52 may engage a portion of the body 26 to fix the panel 28" relative to the body 26 before deployment of the wings 22. The hook 52 releases engagement during deployment of the wing 22 so that the panel 28" is discarded.

Figure 7:
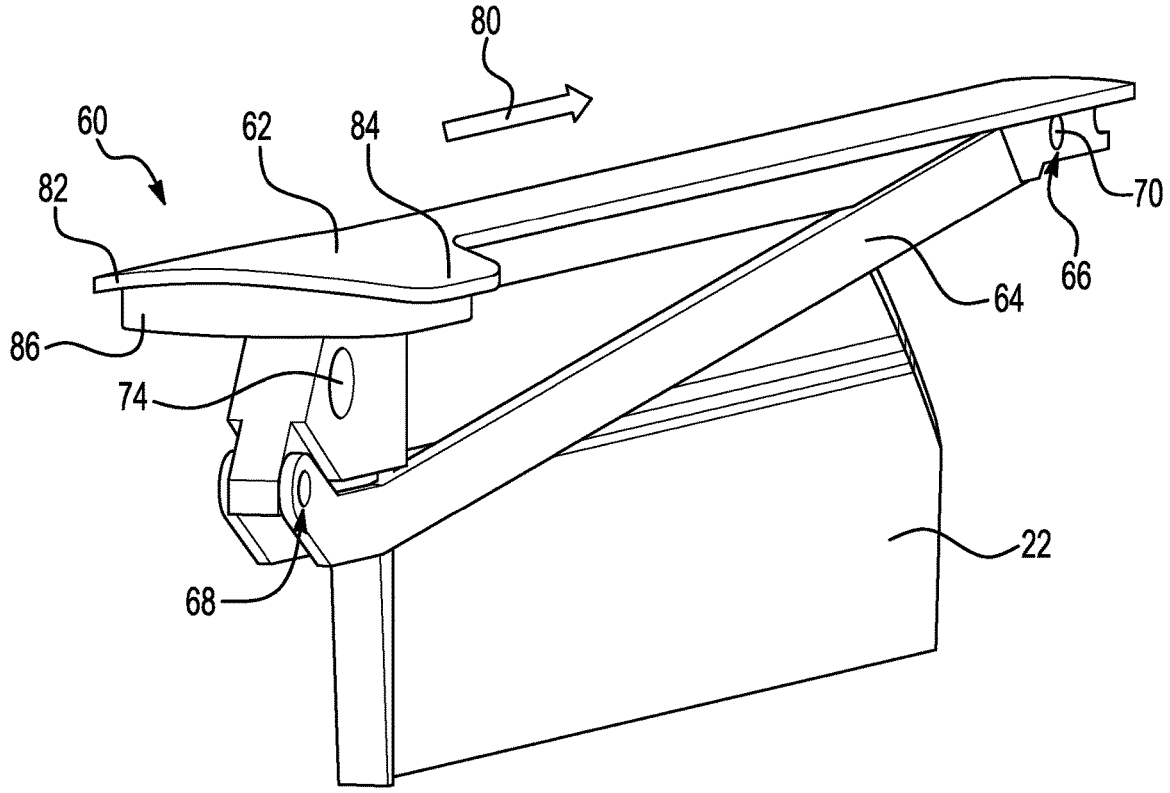
FIG. 7 shows a wing deployment system according to still another exemplary embodiment in which the wing deployment system includes a panel that covers the wing and a linkage that is connected to the panel and the wing for lifting the panel during movement of the wing.
Figure 8:
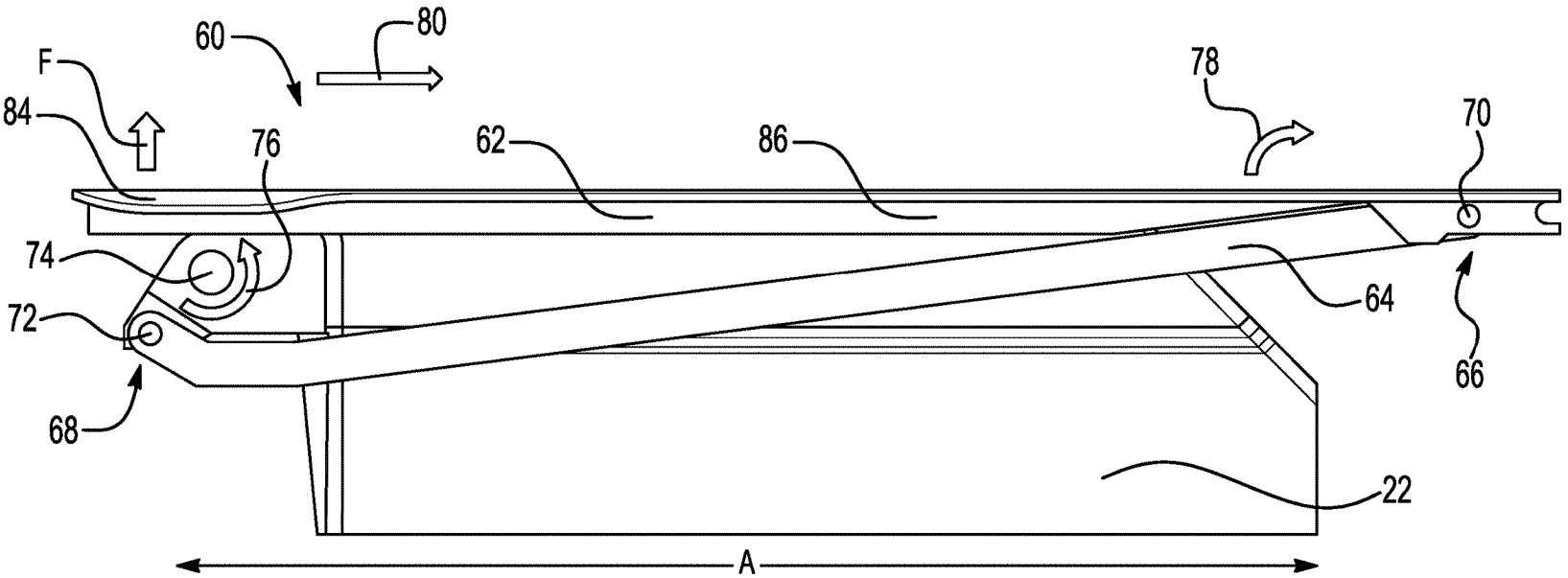
FIG. 8 shows a side view of the wing deployment system of FIG. 7.

Referring now to FIGS. 7 and 8, another exemplary embodiment of the wing deployment system 60 is shown in which the wing deployment system 60 includes a panel 62 and a linkage 64 connected between the panel 62 and the wing 22 for lifting the panel 62 during the initial range of motion of the wing 22. The initial range of motion may be generated by an initial deployment mechanism that acts on the wing 22, such as the spring shown in FIG. 3 or another stored energy release device. Any other suitable initial deployment mechanism may be used. Using the linkage 64 may be advantageous for removing the shock created by explosive devices in some applications.

The linkage 64 includes a first end 66 pivotably connected to the panel 62 and a second end 68 that is opposite the first end 66 and is pivotably connected to the wing 22. The first end 66 may be proximate a rearward end of the wing 22 and the second end 68 may be proximate a forward end of the wing 22 relative to the forward direction of travel of the projectile. The ends 66, 68 may include link pins 70, 72 that are configured to connect the linkage 64 to the panel 62 and to the wing 22, respectively. The link pins 70, 72 may be received through corresponding slots formed in the linkage 64, the panel 62 and the wing 22. The linkage 64 extends along a length L of the wing 22 and may be configured to extend adjacent the opposing sides of the wing 22. As shown in FIG. 8, the linkage 64 and panel 62 may extend past the length L of the wing 22 such that the first end 66 extends past the wing 22.

During deployment, the wing 22 is configured to pivot around a rotation axis 74 of the wing 22 that is arranged proximate the second end 68 and is connected to the body of the projectile. The wing 22 is configured to rotate in a forward direction 76 relative to the forward direction of travel of the projectile on which the wing 22 is arranged, i.e. the wing 22 pivots in the same direction as the direction of travel of the projectile when moving from the folded position to the deployed position. Accordingly, the rearward end of the wing 22 is lifted relative to its initial position. The linkage 64 is configured to pivot the panel 62 in an opposite rotational direction 78 relative to the rotational direction or forward direction 76 of the wing 22 during deployment of the wing 22. In contrast to the winglet 28 shown in FIGS. 1-5, which may remain fixed in position relative to the wing 22 during the initial range of motion, the panel 62 is moved relative to the wing 22 during the initial range of motion.

During the initial range of motion of the wing 22, a forward end of the panel 62 is exposed to the fluid flow 80 such that the forward end of the panel 62 is lifted or subject to the drag force F. When lifted, the panel 62 is rotated about the link pin 70 arranged at the first end 66 of the linkage 64. The drag force may provide the initial deploy moment while the lift force may provide the subsequent sustaining deploy moment for the wing 22.

The panel 62 may be formed to extend over an entire length of the wing 22 and includes planar opposing surfaces 82, 84 that extend perpendicular to opposing sides of the wing 22. The opposing surfaces 82, 84 may be continuously formed and, in an exemplary embodiment, the opposing surfaces 82, 84 may be slightly curved upwardly. The opposing surfaces 82, 84 may be arranged at a forward end of the wing 22 proximate the second end 68 and the rotation axis 74. The opposing surfaces 82, 84 may extend along a length A of the wing 22 that is less than half of the entire length of the wing 22.

The opposing surfaces 82, 84 may be formed as an uppermost surface of the panel 62 that protrudes outwardly from a lower part 86 that surrounds an upper part of the wing 22. The upper surface may have a thickness that is less than a thickness of the lower part 86. The panel 62 may be formed as a single monolithic part and may be formed of any suitable lightweight material. For example, a lightweight metal material may be suitable. The first end 66 of the linkage 64 may be secured to the lower part 86 and extend along the side of the wing 22 toward the second end 68. The second end 68 may be arranged lower than the first end 66 such that the linkage 64 is angled downwardly from the first end 66 to the second end 68. Many other shapes, dimensions, and configurations of the panel 62 may be suitable.

Figure 9:
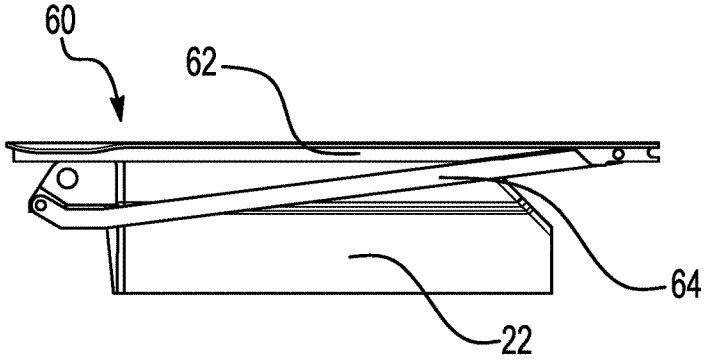
FIG. 9 shows the wing deployment system of FIG. 7 when the wing is in an initial folded position.

FIGS. 9-13 show the sequential deployment of the wing deployment system 60 including the deployment of the wing 22 and the corresponding movement of the panel 62. FIG. 9 shows the initial position of the panel 62 when the wing 22 is in the folded position, such as when the projectile is stowed prior to deployment of the projectile. When in the initial position, the panel 62 extends parallel with the wing 22 and both of the wing 22 and the panel 62 may extend horizontally relative to the direction of travel of the projectile. The linkage 64 may be angled downwardly when the wing 22 is in the folded position.

Figure 10:
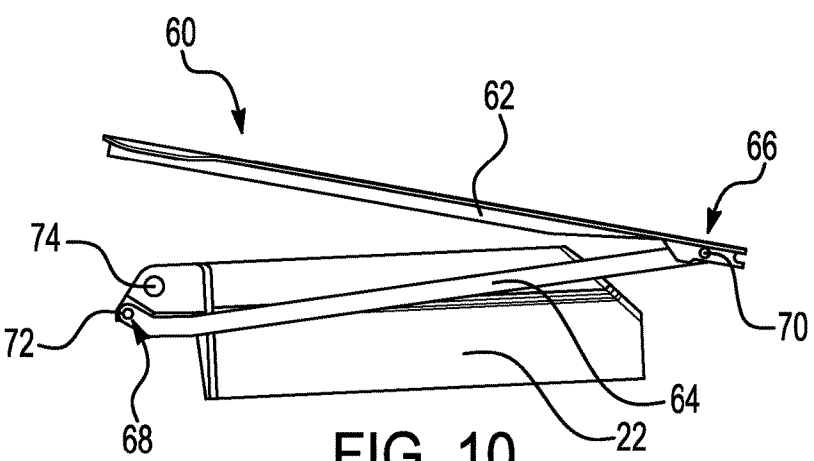
FIG. 10 shows the wing deployment system of FIG. 7 during an initial range of motion of the wing.

FIG. 10 shows a first rotation of the wing 22 about the rotation axis 74 of the wing 22 in the forward direction after deployment of the projectile. Due to the exposure of the panel 62 into the fluid flow surrounding the projectile, the forward end of the panel 62 is lifted relative to the wing 22. The panel 62 is pivoted in the rearward direction, i.e. in the opposite rotational direction relative to the wing 22, about the link pin 70. The movement of the panel 62 about the first end 66 may urge the linkage 64 slightly downwardly relative to the body of the wing 22 such that the second end 68 of the linkage 64 is slightly pivoted in the rearward or downward direction.

Figure 11:
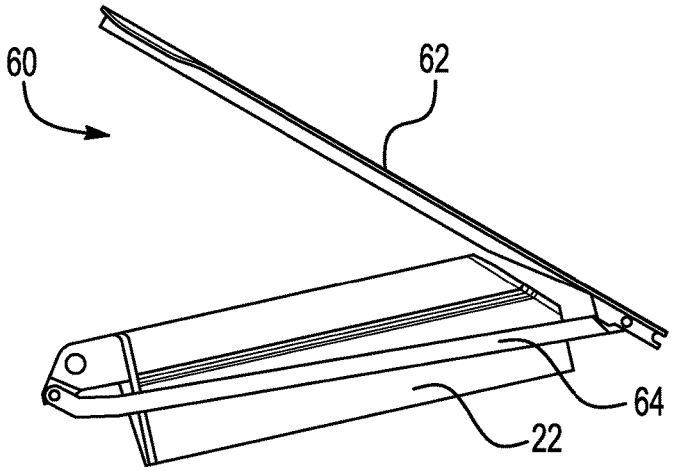
FIG. 11 shows the wing deployment system of FIG. 7 after further rotation of the wing during which the panel is further lifted.
Figure 12:
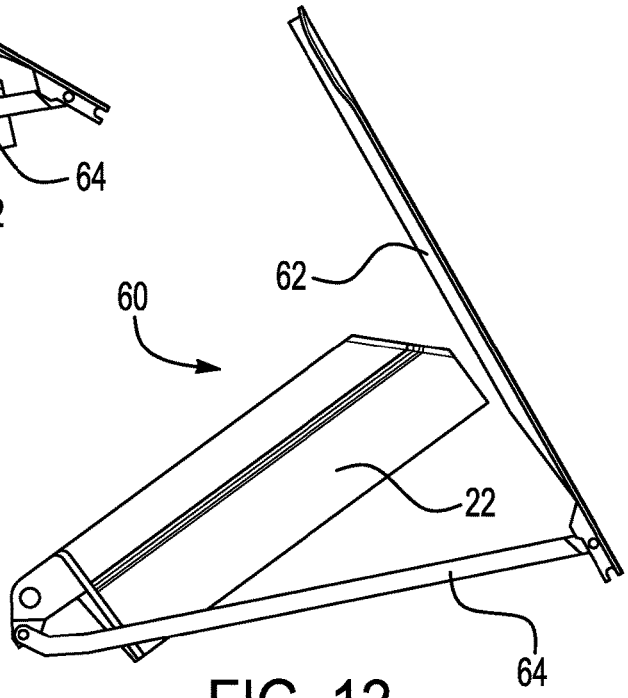
FIG. 12 shows the wing deployment system of FIG. 7 after even further rotation of the wing during which the panel is even further lifted.

FIG. 11 shows a further rotation of the wing 22 in the forward direction in which the panel 62 is pivoted further in the rearward direction. FIG. 12 shows an even further rotation of the wing 22 in the forward direction in which the panel 62 is pivoted further in the rearward direction. The panel 62 may be nearly perpendicular relative to the linkage 64 and the wing 22 may be pivoted to a position in which the wing 22 is positioned mostly above the linkage 64.

Figure 13:
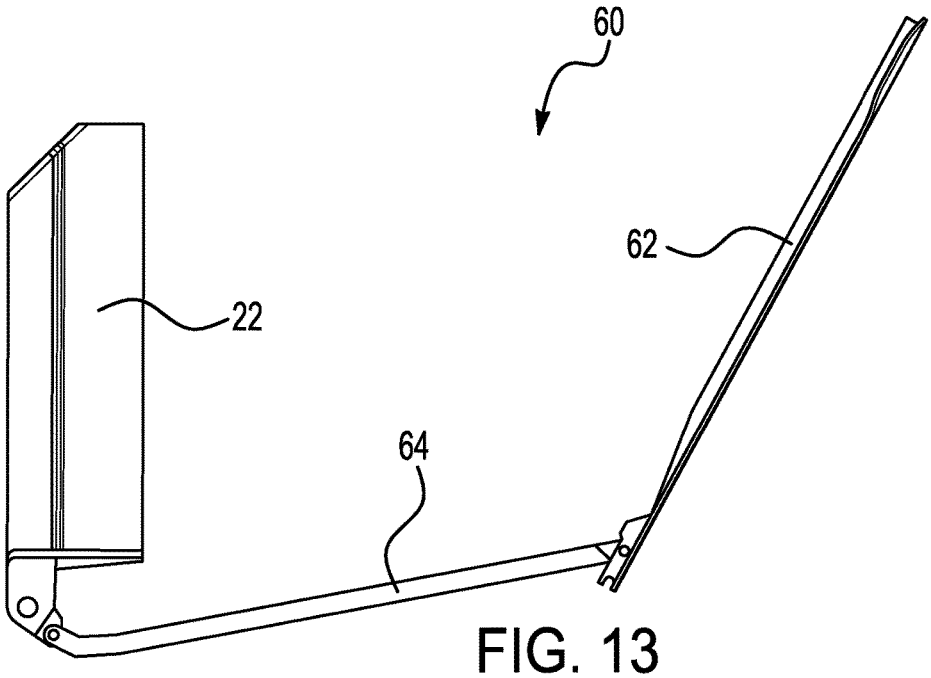
FIG. 13 shows the wing deployment system of FIG. 7 when the wing is in the deployed position and the panel extends away from the wing.

FIG. 13 shows the wing 22 in the deployed position which may be a position in which the wing 22 extends perpendicular relative to the position of the wing 22 when in the folded position (shown in FIG. 9). The panel 62 extends away from the wing 22 and at an angle that is greater than 90 degrees relative to the linkage 64. The panel 62 and linkage 64 may be configured to attach to a body of the projectile for stowage. In other exemplary embodiments, the panel 62 and linkage 64 may be configured to detach from the wing 22 to be discarded from the projectile.

Figure 14:
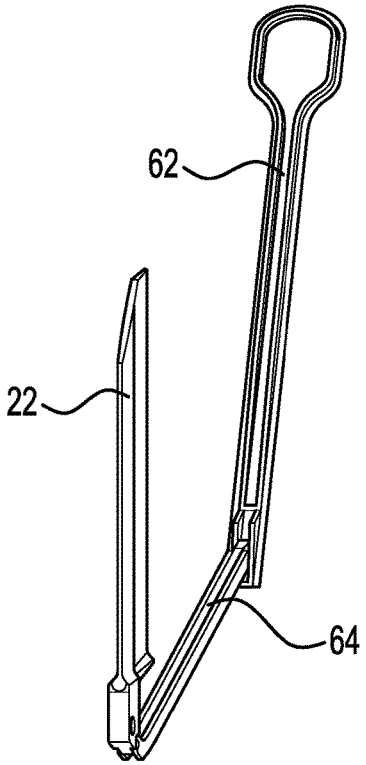
FIG. 14 shows the linkage of the wing deployment system of FIG. 7 according to an exemplary embodiment.
Figure 15:
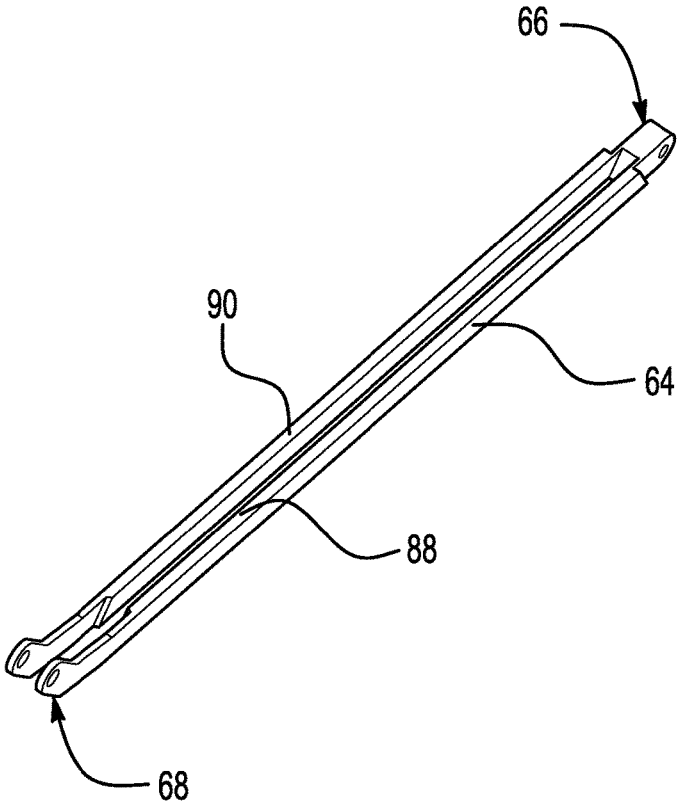
FIG. 15 shows an oblique view of the linkage of FIG. 14.

FIGS. 14 and 15 show an exemplary embodiment of the linkage 64 between the wing 22 and the panel 62. The linkage 64 may be formed as a rigid and unitary component having parallel arms 88, 90 that are spaced to enable the wing 22 to be received between the parallel arms 88, 90. The parallel arms 88, 90 may be secured to the first end 66 of the linkage 64 and the panel 62 may extend over the first end 66 such that the panel 62 may be formed to sandwich the first end 66 of the linkage 64.

At the second end 68 of the linkage 64, the ends of the parallel arms 88, 90 may be free relative to each other such that the parallel arms 88, 90 sandwich the wing 22. A link pin extends through the parallel arms 88, 90 and the wing 22 at the second end 68. The linkage 64 may be formed of any suitable material. For example, a lightweight metal material may be suitable. The linkage 64 may have any other dimensions, shapes, or configurations. For example, a captive sliding plate, tension band, tether, or any alternative mechanical link could be used between the wing or panel instead of the linkage 64.

Figure 16:
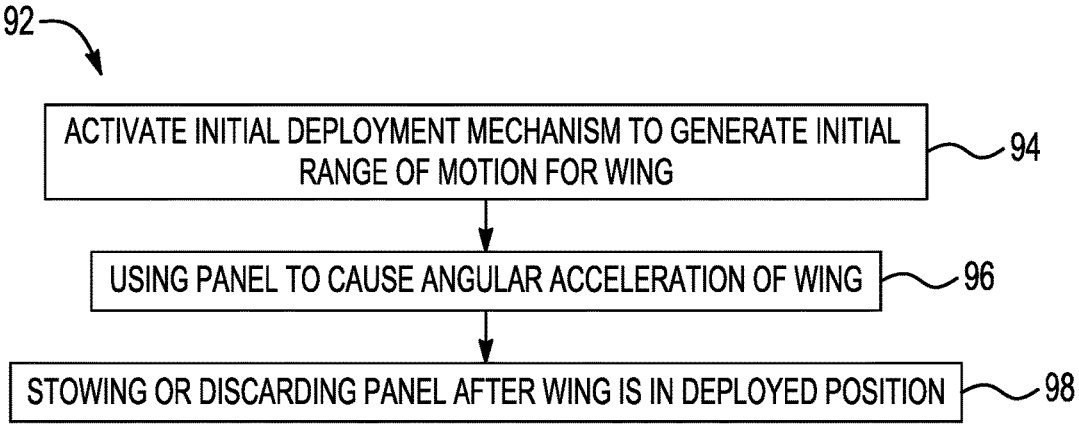
FIG. 16 shows a flowchart for a method of deploying a projectile that uses a wing deployment system, such as the wing deployment system shown in FIGS. 1-15.

FIG. 16 shows a flowchart illustrating a method 92 of deploying a projectile, such as the projectile 24 shown in FIGS. 1-6. The method 92 may include using any of the wing deployment systems 20, 20', 60 shown in FIGS. 1-15. Step 94 of the method 92 includes activating an initial deployment mechanism 30 that acts on the wing 22 to generate an initial range of motion for the wing 22 during which the wing 22 moves out of a folded position toward a deployed position.

Step 96 of the method 92 includes using a panel 28, 28', 28", 62 arranged on the wing 22 to cause an angular acceleration of the wing 22 via a lift or drag force occurring on the panel 28, 28', 28", 62 when the panel 28, 28', 28", 62 is exposed to fluid flow around the projectile that imparts a moment of the wing 22 around a rotation axis or rotation axis 34, 74 of the wing 22. Step 98 of the method 92 includes stowing or discarding the panel 28, 28', 28", 62 after the wing 22 has reached the deployed position.

Although the disclosure describes certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. A wing deployment system for deploying a wing of a projectile, the wing deployment system comprising:

an initial deployment mechanism that acts on the wing to generate an initial range of motion of the wing during which the wing moves from a folded position to a deployed position; and a panel arranged on the wing and configured to cause an angular acceleration of the wing during the initial range of motion of the wing, wherein the panel is arranged at an end of the wing that is opposite a rotation axis of the wing and the panel is a monolithic winglet inserted into a slot extending from an outer edge of the wing.

2. The wing deployment system according to claim 1, wherein the panel is configured to incur a lift or drag force when the panel is exposed to fluid flow around the projectile, the lift or drag force on the panel imparting a moment of the wing around a rotation axis of the wing to cause the angular acceleration.

3. The wing deployment system according to claim 1, wherein the panel has at least one surface that extends perpendicular to a side of the wing.

4. The wing deployment system according to claim 1, wherein the panel has opposing flaps that extend outwardly from opposing sides of the wing.

5. The wing deployment system according to claim 1, wherein the panel is a winglet having a U-shaped body that is inserted into a slot formed in the wing.

6. The wing deployment system according to claim 1 further comprising a linkage connected between the panel and the wing for lifting the panel during the initial range of motion of the wing.

7. The wing deployment system according to claim 6, wherein the linkage has a first end pivotably connected to the panel and a second end that is opposite the first end and pivotably connected to the wing.

8. The wing deployment system according to claim 7, wherein the linkage is configured to pivot the panel in an opposite rotational direction relative to a rotational direction in which the wing is pivoted during movement from the folded position to the deployed position.

9. The wing deployment system according to claim 7 further comprising link pins arranged at the first end and the second end of the linkage.

10. The wing deployment system according to claim 1, wherein the panel is removably attached to the wing and configured to be discarded from the wing after the wing is in the deployed position.

11. A projectile comprising:

a wing that is movable from a folded position to a deployed position;

an initial deployment mechanism that acts on the wing to generate an initial range of motion of the wing during which the wing moves out of the folded position toward the deployed position;

a panel arranged on the wing and configured to cause an acceleration torque of the wing during the initial range of motion of the wing, wherein the panel includes a linkage connected between the panel and the wing for lifting the panel during the initial range of motion of the wing; and the wing is configured to move in a forward direction relative to a forward direction of travel of the projectile during movement from the folded position to the deployed position, and wherein the panel is configured to move in a rearward direction.

12. The projectile according to claim 11, wherein the panel is configured to incur a lift or drag force when the panel is exposed to fluid flow around the projectile, the lift or drag force on the panel imparting a moment of the wing around a rotation axis of the wing to cause the angular acceleration.

13. The projectile according to claim 11, wherein the panel is a winglet and the wing is configured to move in a rearward direction relative to a forward direction of travel of the projectile during movement from the folded position to the deployed position.

14. The projectile according to claim 13, wherein the wing defines a slot extending from an outer edge of the wing and the winglet is inserted in the slot.

15. The projectile according to claim 14, wherein the winglet has opposing flaps that extend outwardly from a U-shaped body that is received in the slot and extends along a surface of the wing.

16. The projectile according to claim 11, wherein the panel is configured to be discarded from the projectile after the wing is in the deployed position.

17. A method of deploying a projectile, the method comprising:

activating an initial deployment mechanism that acts on a wing of the projectile to generate an initial range of motion for the wing during which the wing moves out of a folded position toward a deployed position;

using a panel arranged on the wing to cause an angular acceleration of the wing via a lift or drag force occurring on the panel when the panel is exposed to fluid flow around the projectile that imparts a moment of the wing around a rotation axis of the wing, wherein the panel is arranged at an end of the wing that is opposite a rotation axis of the wing and the panel is a monolithic winglet inserted into a slot extending from an outer edge of the wing; and stowing or discarding the panel after the wing is in the deployed position.

* * * * *